US007499655B2

(12) United States Patent
Yamauchi et al.

(10) Patent No.: US 7,499,655 B2
(45) Date of Patent: Mar. 3, 2009

(54) IMAGE FORMING METHOD AND IMAGE FORMING APPARATUS INCLUDING DECOLORIZATION COUNTER AND ORDINARY COUNTER

(75) Inventors: Toshiaki Yamauchi, Kanagawa-ken (JP); Shuitsu Sato, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 185 days.

(21) Appl. No.: 11/272,874

(22) Filed: Nov. 15, 2005

(65) Prior Publication Data

US 2006/0115283 A1 Jun. 1, 2006

(30) Foreign Application Priority Data

Nov. 30, 2004 (JP) ..... 2004-346854

(51) Int. Cl.
*G03G 15/00* (2006.01)
*G03G 15/08* (2006.01)

(52) U.S. Cl. ..... 399/24; 399/27

(58) Field of Classification Search ..... 399/24, 399/27

See application file for complete search history.

(56) References Cited

U.S. PATENT DOCUMENTS

| | | | | |
|---|---|---|---|---|
| 5,394,231 | A | 2/1995 | Sudo et al. | |
| 5,797,061 | A * | 8/1998 | Overall et al. | 399/27 |
| 5,922,115 | A | 7/1999 | Sano et al. | |
| 6,535,712 | B2 * | 3/2003 | Richards | 399/341 |
| 2005/0025507 | A1 * | 2/2005 | Ishii et al. | 399/27 |
| 2005/0163532 | A1 * | 7/2005 | Tsuruya et al. | 399/119 |

FOREIGN PATENT DOCUMENTS

JP 06-095494 A 4/1994

* cited by examiner

*Primary Examiner*—Quana M Grainger
(74) *Attorney, Agent, or Firm*—Foley & Lardner LLP

(57) ABSTRACT

Image forming histories when decolorization toner is used by a first counter or a second counter and when ordinary toner is used are counted respectively, and image forming histories of a decolorization developing device and an ordinary developing device are counted by a third counter or a fourth counter, and life control is executed for expendables, and adjustment of process conditions is controlled.

3 Claims, 8 Drawing Sheets

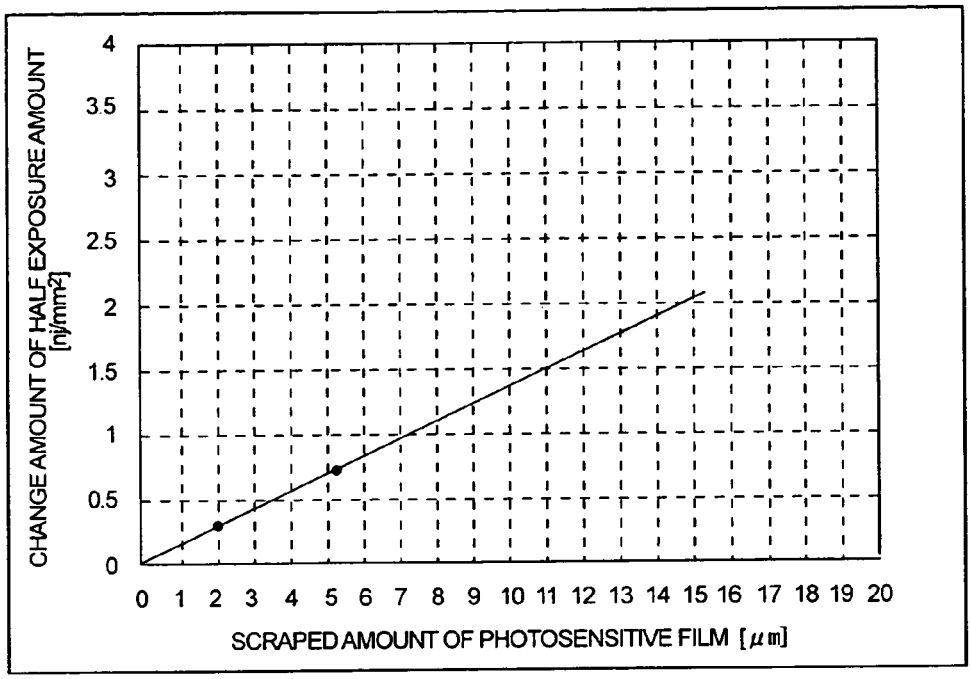
FIG. 8
| | | 0 SHEETS | 60,000 SHEETS | 120,000 SHEETS |
|---|---|---|---|---|
| FILM SCRAPED AMOUNT (μm) | ORDINARY TONER | 0.0 | 7.0 | 13.6 |
| | DECOLORIZATION TONER | 0.0 | 3.3 | 6.5 |
| GRID BIAS VOLTAGE (V) | ORDINARY TONER | 736 | 749 | 787 |
| | DECOLORIZATION TONER | 736 | 742 | 748 |
| HALF EXPOSURE AMOUNT (nj/mm2) | ORDINARY TONER | 3.5 | 4.4 | 5.3 |
| | DECOLORIZATION TONER | 3.5 | 3.9 | 4.3 |
FIG. 9
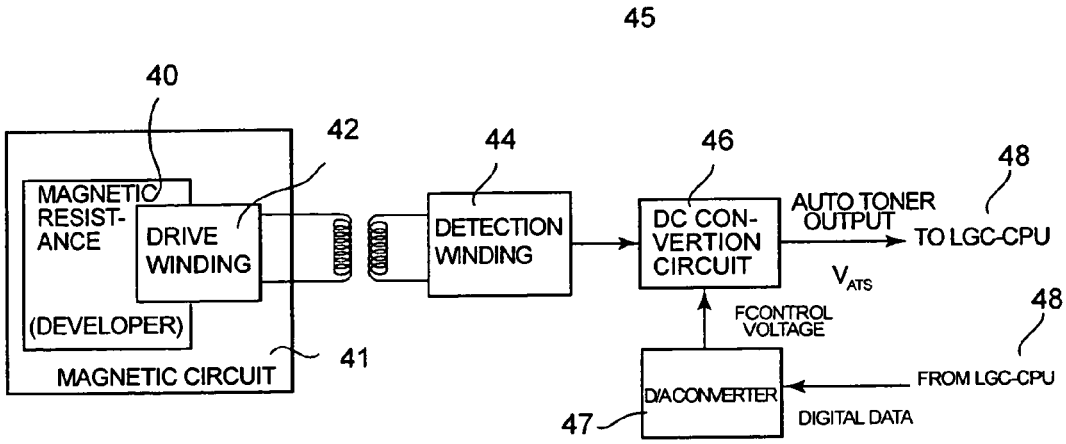
FIG. 10

| | | 0 SHEETS | 60,000 SHEETS | 120,000 SHEETS |
|---|---|---|---|---|
| INITIAL BIT VALUE | ORDINARY TONER | 140 | | |
| | DECOLORIZATION TONER | 128 | | |
| BIT VALUE CHANGE (Δ BIT) | ORDINARY TONER | 0 | -2 | -4 |
| | DECOLORIZATION TONER | 0 | +5 | +6 |
| SPECIFIC DENSITY OF TONER (wt%) | ORDINARY TONER | 5.0 | 5.2 | 5.1 |
| | DECOLORIZATION TONER | 3.0 | 2.9 | 3.0 |

IMAGE FORMING METHOD AND IMAGE FORMING APPARATUS INCLUDING DECOLORIZATION COUNTER AND ORDINARY COUNTER

CROSS-REFERENCE TO RELATED APPLICATION

This application is based upon and claims the benefit of priority from the prior Japanese Application No. 2004-346854, filed on Nov. 30, 2004, the entire contents of all of which are incorporated herein by reference.

FIELD OF THE INVENTION

The present invention relates to an image forming method and an image forming apparatus capable of using both decolorization toner and ordinary toner.

DESCRIPTION OF THE BACKGROUND

In recent years, for saving of resources, in place of paper recycle use of recycling used papers, to be suited to further saving of resources and environmental protection, an art for reusing papers has been developed. The paper reuse eliminates image information printed on a paper using a decolorization toner and repeatedly uses the same paper several times to ten times or so to output new image information. By doing this, the use amount of paper can be reduced greatly and energy conservation and resource saving can be realized. Therefore, by a method for stripping the decolorization toner mechanically or chemically after printing so as to repeatedly reuse a paper, the printed part can be eliminated. Or, by a method for reacting the decolorization toner with heat, light, or chemicals, the printed part can be eliminated. As mentioned above, the decolorization toner is different in the characteristic from ordinary toner.

Conventionally, as an apparatus for forming images using such a decolorization toner, for example, as disclosed in Japanese Patent Application Publication No. 6-95494, there is an image forming apparatus available for executing both image forming by an ordinary toner and image forming by a decolorization toner.

The image forming apparatus disclosed in Japanese Patent Application Publication No. 6-95494 is equipped with both a developing device for developing by an ordinary toner which can retain printed images in the image forming apparatus for a long period of time and a developing device for developing by a decolorization toner, selects either of the developing devices, and forms images under the process condition according to the concerned toner.

However, the decolorization toner and ordinary toner are different in the toner characteristic from each other, so that between image forming by the decolorization toner and image forming by the ordinary toner, various process conditions for image forming are different. Furthermore, image forming by the decolorization toner, on the assumption of decolorization like a simple memo, does not always pursue image quality. As compared with it, the ordinary toner is used for official letters for long-term retention or submission to outside and is required for high image quality. As mentioned above, the decolorization toner and ordinary toner are different in the use object, thereby are different in the image output characteristic.

As mentioned above, although the decolorization toner and ordinary toner are different in use and characteristic from each other, as the image forming apparatus disclosed in Japanese Patent Application Publication No. 6-95494, when it is intended to obtain satisfactory image forming by both toners by the same image forming apparatus, the image forming process is different between the toners. Therefore, due to a difference between the number of times of image forming using the decolorization toner and the number of times of image forming using the ordinary toner, the life of various expendables is changed. Further, the adjustment of various process conditions for image quality maintenance is changed, so that appropriate life control of expendables and appropriate adjustment of the image process conditions cannot be realized and a problem arises that the image quality is lowered.

SUMMARY OF THE INVENTION

An object of the present invention is to provide an image forming apparatus capable of using both decolorization toner and ordinary toner and an image forming method, regardless of respective image forming histories of the decolorization toner and ordinary toner, for executing appropriate life control of various expendables and realizing effective use of the apparatus, adjusting process conditions respectively suited to both toners, thereby obtaining high image quality.

According to the embodiment of the present invention, there is provided an image forming method for switching and using a decolorization toner or an ordinary toner and forming a toner image, comprising: counting the number of times of image forming by the decolorization toner when the decolorization toner is used; counting the number of times of image forming by the ordinary toner when the ordinary toner is used; detecting life of the decolorization toner and ordinary toner on the basis of the counted values; and giving a warning when it is found from the detection of the life that either of the toners is not used within a range of life.

Furthermore, according to the embodiment of the present invention, there is provided an image forming apparatus for switching and using a decolorization toner or an ordinary toner and forming a toner image, comprising: a common expendable used in common in both image forming by the decolorization toner and the ordinary toner; a decolorization expendable used only for the toner image forming by the decolorization toner; an ordinary expendable used only for the toner image forming by the ordinary toner; a decolorization counter to count the number of times of use of the decolorization toner; and an ordinary counter to count the number of times of use of the ordinary toner, wherein: a life control is executed on the basis of both counted values of the decolorization counter and the ordinary counter for the common expendable, a life control is executed on the basis of the counted value of the decolorization counter for the decolorization expendable, and a life control is executed on the basis of the counted value of the ordinary counter for the ordinary expendable.

Furthermore, according to the embodiment of the present invention, there is provided an image forming apparatus for switching and using a decolorization toner or an ordinary toner and forming a toner image, comprising: a common expendable used in common in both the image forming by the decolorization toner and the ordinary toner; a decolorization expendable used only for the toner image forming by the decolorization toner; an ordinary expendable used only for the toner image forming by the ordinary toner; a decolorization counter to count the number of times of use of the decolorization toner; and an ordinary counter to count the number of times of use of the ordinary toner, wherein: a process condition is adjusted on the basis of both counted values of the decolorization counter and the ordinary counter for the common expendable, a process condition is adjusted on the basis of the counted value of the decolorization counter for the decolorization expendable, and a process condition is adjusted on the basis of the counted value of the ordinary counter for the ordinary expendable.

BRIEF DESCRIPTION OF THE DRAWINGS

FIG. 8 is a graph showing the half exposure amount of the surface potential of the photosensitive drum of decolorization toner and ordinary toner due to changing in the scraped amount of the photosensitive layer;

FIG. 9 is a table showing the grid bias potential and half exposure amount according to the history of image forming of decolorization toner and ordinary toner;

FIG. 10 is a schematic block diagram showing the magnetic permeability sensor;

DETAILED DESCRIPTION OF THE EMBODIMENTS

Figure 1:
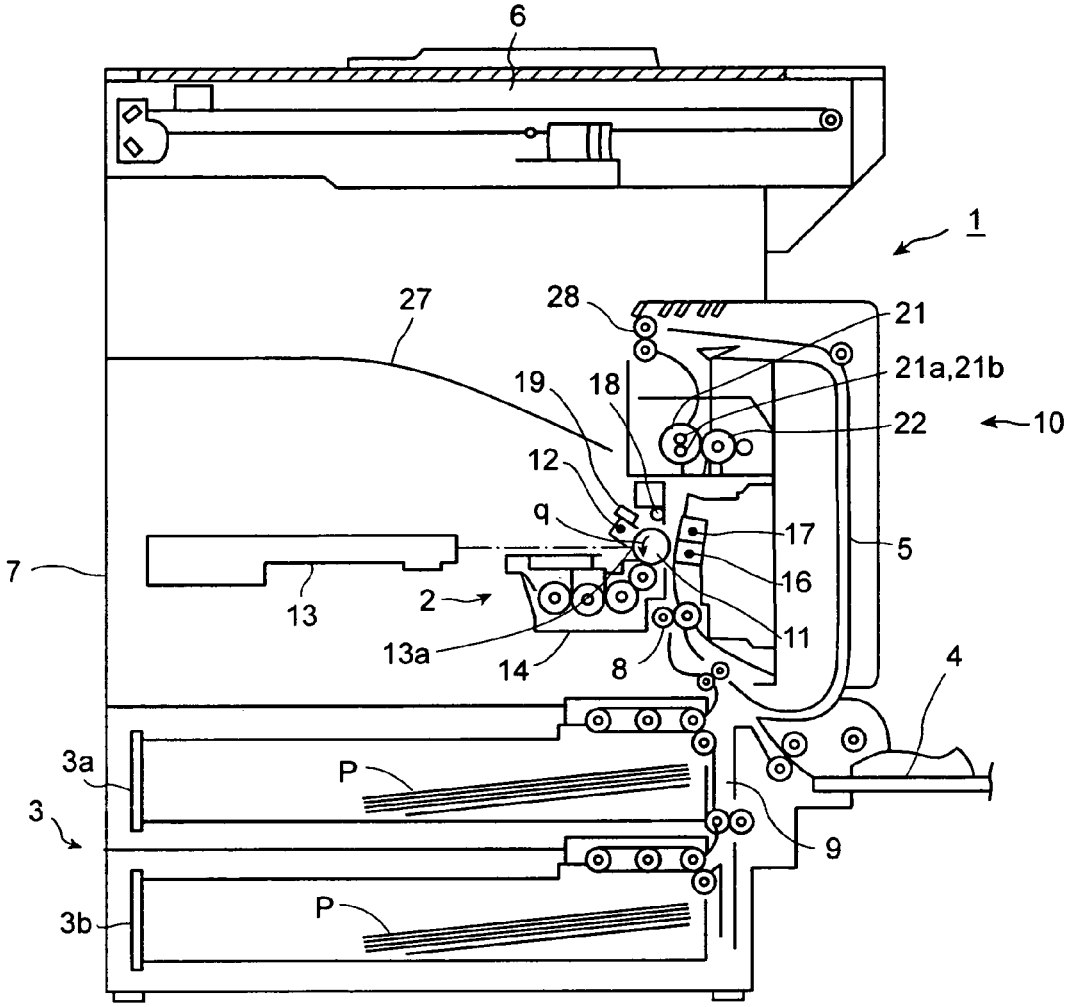
FIG. 1 is a schematic block diagram showing the image forming apparatus of an embodiment of the present invention.

The present invention counts the image forming history by decolorization toner and the image forming history by ordinary toner, independently executes life control of various expendables from both count information and adjusts the process conditions.

Embodiment 1

Generally, when forming an image using decolorization toner, since it is a main object to reuse a paper, it is considered that there is no need to take the image quality into consideration so much. However, actually, if the image density is excessively low or an image is disordered, it cannot be said that it is practical. Moreover, if the image density is excessively high, a problem arises that when eliminating the color later, it cannot be eliminated sufficiently. Therefore, when forming an image, it is necessary to take these into account and adjust various process conditions. Further, when forming an image using ordinary toner, even if the image density is high to a certain extent, it provides no trouble. However, to obtain high image quality free of photographic fog and scattering of toner, various process conditions must be adjusted. Therefore, decolorization toner and ordinary toner are different in the adjustment of the process conditions for image forming.

Not only the adjustment of the process conditions due to the aforementioned difference in the use object but also the process conditions for image forming, to obtain satisfactory development when the toner characteristics are different, such as the charging characteristic of the photosensitive drum, the exposure characteristic, and furthermore the developing characteristic must be executed. Generally, the decolorization toner, unlike the ordinary toner, uses a coloration compound such as a leuco dye in place of carbon black or color pigments. However, the decolorization toner shows a tendency not only to change the electric resistance during repetition of image forming but also to change the developing characteristic due to an occurrence of a difference in the charging characteristic.

In the photosensitive drum, according to the history of image forming, the photosensitive film is scraped. When the photosensitive film is scraped and the thickness thereof is reduced, even if the same amount of charge is given to the surface, the distance from the conductive layer is changed, thus the potential of the surface is increased. Therefore, to obtain a stable image, it is necessary to change, according to the history of image forming, the process conditions such as the charge amount to be given to the photosensitive drum, the exposure amount, or the developing bias potential. However, it is ascertained from the experiment that the wear rate of the photosensitive film due to the history of image forming of the photosensitive drum when decolorization toner is used is far lower than that when ordinary toner is used.

It is ascertained that in addition to the photosensitive drum, also with respect to the expendables (at least one of a cleaning member such as a cleaning blade, a transferring member such as a transferring roller and belt, and a fixing member such as a heat roller) which are used in common for image forming of decolorization toner and image forming of ordinary toner, similarly to the aforementioned example of reduction of the photosensitive film of the photosensitive drum, between a case of use of decolorization toner and a case of use of ordinary toner, the degree of consumption is different and the life is changed.

In the image forming apparatus, the image quality is changed depending on differences in the use frequency of the apparatus and the environmental conditions. To minimize such change in the image quality and obtain a stable image quality, the image forming process conditions have been adjusted conventionally according to the use frequency and environmental change. Namely, to make the surface potential of the photosensitive drum during charging or the potential of the exposing portion or non-exposing portion during exposing constant to a certain extent, expecting a reduction in the film thickness of the photosensitive drum according to the use frequency, the corona current of the corona main charger, the bias potential of the charging roller, and the developing bias potential are changed. Furthermore, when the developing device uses a 2-component developer, the mixing ratio of a toner and a carrier and the charging amount are changed due to the use frequency and environmental change and the developing characteristic, for example, the image density is changed. Therefore, the image control such as setting the specific density of toner constant on a predetermined level and adjusting the developing bias potential is executed.

As mentioned above, the adjustment of the image forming process conditions is affected by various factors such as not only the charging characteristic of toner to be used but also the wear condition of the respective expendables and environmental change. Therefore, generally, the standard degree of change of each of the process conditions (the potential of the photosensitive drum, the specific density of toner, etc.) for image forming due to various factors is retained in the memory as a data table. According to the image forming history and environmental change, the set value is called from the data table and the process conditions are adjusted. Moreover, for the expendables used for the transferring process and fixing process, the exchange time is shown according to the standard life. Furthermore, when necessary, for example, the adjustment of the transferring bias characteristic of the transferring process and the adjustment of the fixing temperature characteristic of the fixing process are executed.

Therefore, an image forming apparatus which can execute both image forming by decolorization toner and image forming by ordinary toner controls the developing bias potential and specific density of toner for each toner used. Furthermore, to control the life of each expendable and stabilize the charging characteristic of the photosensitive drum shared by both toners, the apparatus must detect the image forming history for each toner and adjust the image forming process conditions according to the accurate reduction amount of the film thickness of the photosensitive drum. Furthermore, even the transferring device and fixing unit shared by both toners must adjust various process conditions according to the image forming history of each toner.

This embodiment is executed in consideration of the aforementioned. Hereinafter, an embodiment of the present invention will be explained with reference to FIGS. 1 to 13. FIG. 1 is a schematic block diagram showing, for example, multi function peripheral (hereinafter, abbreviated to MFP) 1 which is an example of the image forming apparatus of the present invention. MFP 1 can input image information from a personal computer by a two-way interface like a network line which is integrally incorporated with a scanner and a printer and image information from a facsimile connected by a telephone line.

Figure 2:
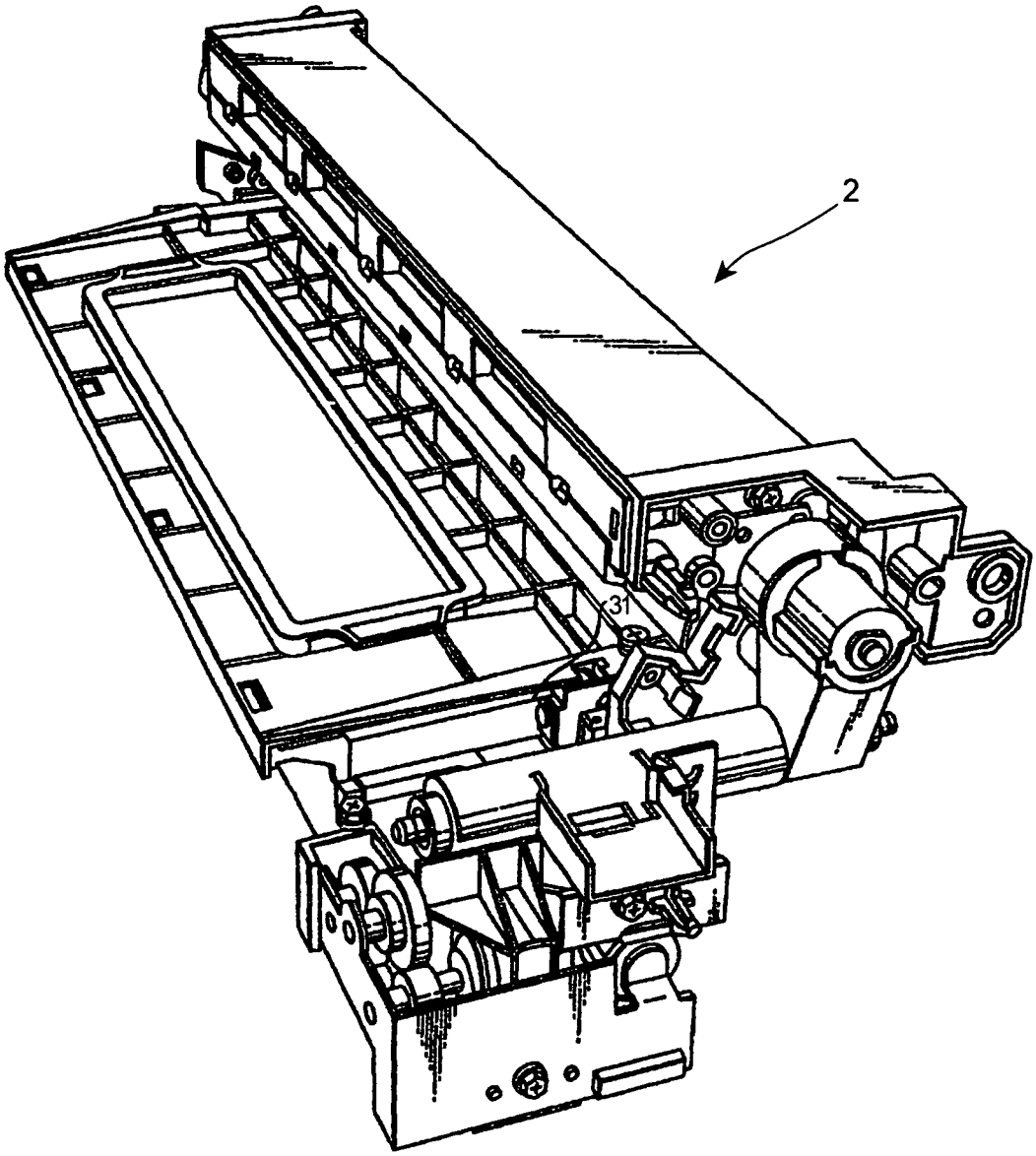
FIG. 2 is a perspective view showing the processing unit exchangeably installed in the image forming apparatus of an embodiment of the present invention.

On the top of the main body of MFP 1, scanner unit 6 for reading a document image is installed. On printer unit 7 under scanner unit 6, processing unit 2 shown in FIG. 2 is installed. Processing unit 2 is exchangeably mounted on the main body of the apparatus. Processing unit 2 includes, for example, photosensitive drum 11 coated or deposited with a photosensitive film of an organic semiconductor or an inorganic semiconductor such as Se on the surface of a drum-shaped aluminum conductor. Around photosensitive drum 11 in processing unit 2, in the rotational direction of arrow q of photosensitive drum 11, main charger 12 for uniformly charging photosensitive drum 11 and developing device 14 for converting an electrostatic latent image formed on photosensitive drum 11 to a toner image are arranged sequentially. In developing device 14, a developing roller as a toner supply body for supplying toner to the electrostatic latent image formed on photosensitive drum 11 is installed. Namely, processing unit 2 is exchangeably mounted on the main body of the apparatus so as to exchange photosensitive drum 11, main charger 12, and developing device 14. In the main body of the apparatus, exposing portion 13*a* of laser exposure unit 13 for forming a latent image on charged photosensitive drum 11 on the basis of image data from scanner unit 6, transferring charger 16, separation charger 17, cleaner 18 which is a toner collection unit, and charge elimination LED 19 are arranged additionally. In developing device 14, decolorization developing device 14*a* for developing by decolorization toner simultaneously containing a coloration compound such as a leuco dye, a coloration agent, and a decolorization agent and ordinary developing device 14*b* for developing by ordinary toner are arranged exchangeably.

Under photosensitive drum 11 of processing unit 2, cassette structure 3 having paper supply cassettes 3*a* and 3*b* for supplying papers P to the position of transferring charger 16 around photosensitive drum 11 and manual paper supply structure 4 are installed. Furthermore, MFP 1 has paper reverse conveying route 5 for reversing papers P at time of double side image forming. On conveying route 9 from cassette structure 3, manual paper supply structure 4, and paper reverse conveying route 5 to transferring charger 16, aligning roller 8 is installed. Between separation charger 17 around photosensitive drum 11 and paper discharging portion 27, fixing unit 10 composed of heat roller 21 containing center heater lamp 21*a* and side heater lamp 21*b* and pressing roller 22 and paper discharging roller 28 are installed.

Figure 3:
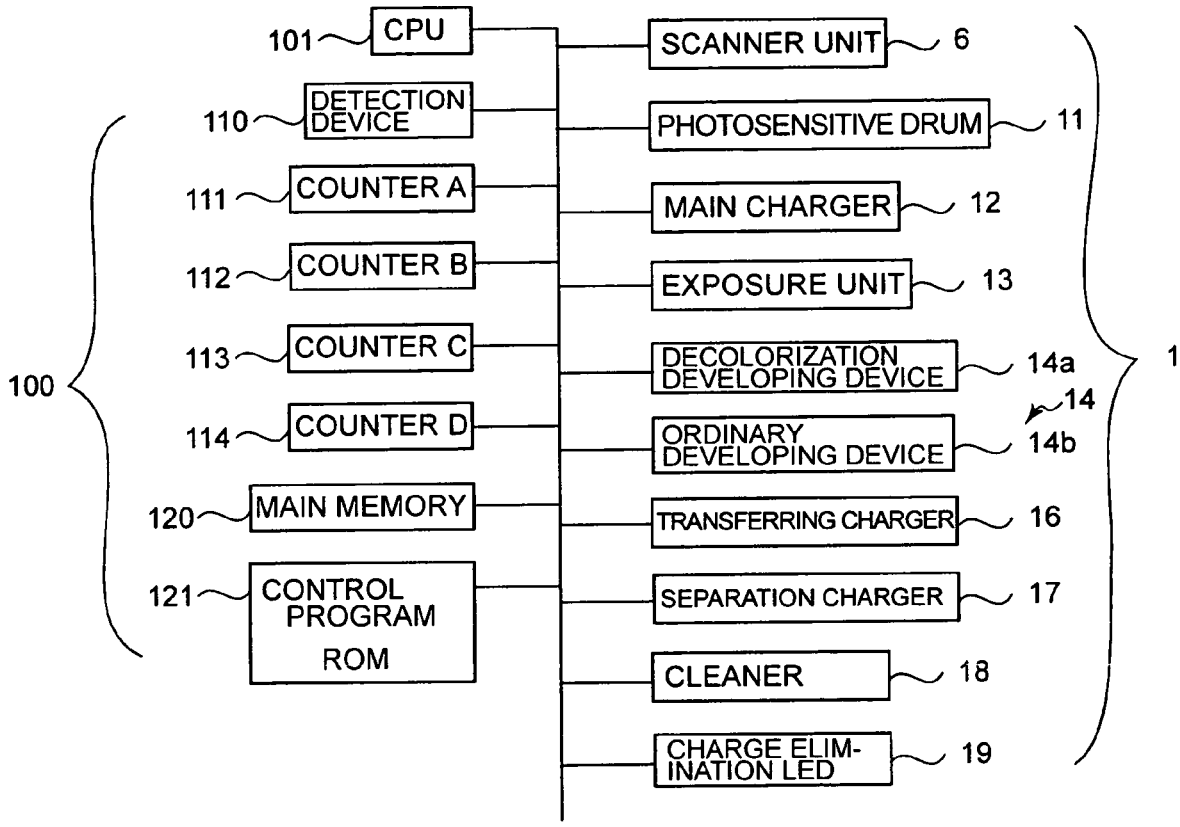
FIG. 3 is a block diagram showing a part of the image forming apparatus of an embodiment of the present invention.

FIG. 3 is a block diagram showing control system 100 for adjusting the life control of the expendables of MFP 1 and the process conditions. Control system 100 is controlled by CPU 101 for controlling overall MFP 1. Control system 100 has detecting device 110 for detecting whether decolorization developing device 14*a* is used as developing device 14 and various decolorization units including a toner cartridge are used or ordinary developing device 14*b* is used as developing device 14 and various ordinary units are used. Control system 100 has counter A111 for counting image forming histories by decolorization toner, counter B112 for counting image forming histories by ordinary toner, developer counter C113 for counting developer histories of decolorization developing device 14*a*, and developer counter D114 for counting developer histories of ordinary developing device 14*b*. Further, as an example of the method of "counting image forming histories", counting of the number of prints is included. "Counting developer histories" includes rotation of the developing roller for warming-up instead of development and counting of the number of times of stirring of toner.

Furthermore, control system 100 has main memory 120 having a data table and control program 121 for adjusting process conditions of the respective expendables in a ROM. The data table retains information necessary for various control such as the life constant of each of the expendables when in use and differences in change of the specific density of decolorization toner or ordinary toner. Further, the calculation results of "life constant x counted value" aforementioned are given in the table shown in FIG. 9. Further, one data table may retain information of both decolorization toner and ordinary toner and different data tables may be provided for decolorization toner and ordinary toner.

When exchanging decolorization developing device 14*a* and ordinary developing device 14*b*, which one is decolorization toner or ordinary toner is discriminated by detecting device 110. For this discrimination, for example, it is possible to install a mechanical projection, which is image discrimination information, in each exchangeable developing device and install a means for detecting the projection such as a microswitch in the place where the expendables on the main body side of the MFP are received. Or, each toner can be discriminated using radio waves by non-contact such as a radio tag. Furthermore, a means such as a contact type IC chip, a magnetic reader, or a bar code reader can be used.

In a simple switch, by discrimination of two kinds of decolorization toner and ordinary toner, the counter used for each expendable is stored and controlled in the main body of the MFP. However, a complicated case occurs that there are a plurality of decolorization toners or ordinary toners instead of one, which must be controlled, so that at time of exchange, to prevent an occurrence of errors, it is necessary to give a memory to each expendable itself and control the exchange time.

Generally, in one MFP 1, when switching decolorization developing device 14*a* and ordinary developing device 14*b* by pulling in or out by a user, it is important to discriminate whether various expendables for decolorization toner are used or various expendables for ordinary toner are used. The range of the expendables is varied with the process structure of MFP 1 and design and for example, it is a simple such as only a toner cartridge, or it is a unified developing device, or not only the developing device but also the main charger and photosensitive drum are unified, so that the range is not limited.

Furthermore, the photosensitive drum is unified independently and all the devices including the fixing device are included within the range of the expendables. And each expendable can be changed and controlled as a one only for decolorization toner or as a one only for ordinary toner. Or, by use of both toners in common, the number of times can be counted, recorded, and controlled according to the use of both toners using counters 111 to 114.

Next, the procedure of the life control by control system 100 will be explained. Firstly, when which is to be used, decolorization toner or ordinary toner, to form images is selected by a user by MFP 1, detecting device 110 detects whether the expendable in MFP 1 or the exchanged expendable is appropriate or has done its term of service. As a result of detection, when the expendable is not appropriate or has done its term of service, a warning is shown on a display of control panel 30 which is not drawn. The indication method can show the warning part by graphics or a warning sentence. Further, when necessary, according to the warning, the main body of MFP 1 can be put into a non-operation state.

As a concrete example, when using different fixing units 10 for decolorization toner and ordinary toner, if a correct fixing unit is not mounted, a warning can be given. Further, even when using same fixing unit 10 for both decolorization toner and ordinary toner, if the life at time of use of the decolorization toner and the life at time of use of the ordinary toner are different from each other, it is possible to detect according to the toner kind whether the life has expired and give a warning when the life has expired.

Figure 4:
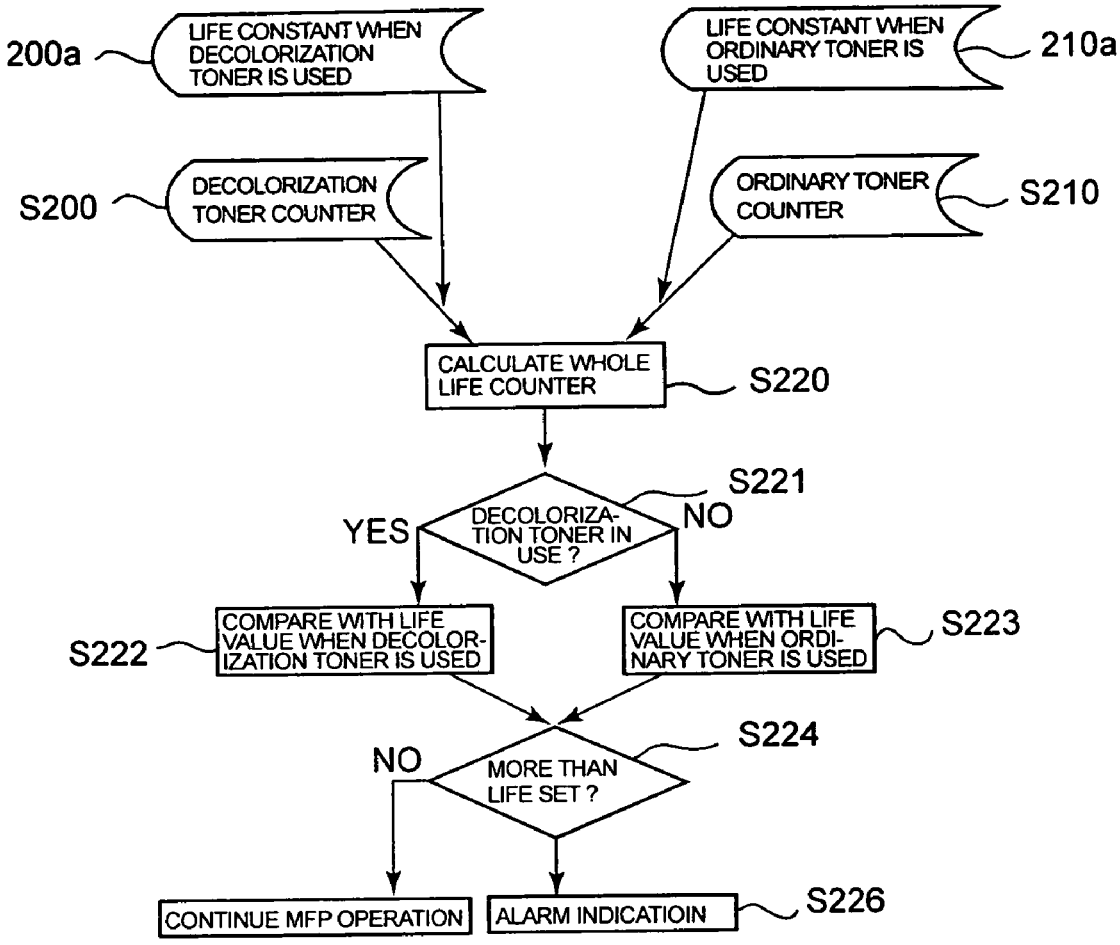
FIG. 4 is a flow chart showing lift control of the image forming apparatus of an embodiment of the present invention.

Next, as shown in the flow chart in FIG. 4, each of counters 111 to 114 corresponding to the expendable used whenever the image forming operation is performed by MFP 1 is counted up by 1. In this embodiment, separately in a case of use of decolorization toner by MFP1 and a case of use of ordinary toner, counter A111 or counter B112 is counted up at Step S200 or Step S210. Simultaneously with this count-up, counter C113 of decolorization developing device 14*a* and developer counter D114 of ordinary developing device 14*b* are counted up. The counter for detecting the life of each expendable, when it is unified, is set for each unit, thus the counter for the whole MFP is set. Or, when it is not unified, the counter is set for each expendable and the life of the other expendables is detected in the same way.

When counted up at Step S200 or Step S210, for decolorization toner and ordinary toner, life constant 200*a* or 210*a* at time of use of each expendable which is stored in main memory 120 is multiplied by the counted value by counter A111 or counter B112 as a multiplier. Further, in main memory 120, the set value of the life of each expendable is stored.

Next, at Step S220, the total count when decolorization toner and ordinary toner are used is calculated. Namely, the counted values of both counters are added up. Next, at Step S221, it is discriminated whether decolorization toner is in use or not. When MFP 1 is using decolorization toner (YES at S221), the process goes to S222 and the sum is compared with the life value of the expendable when decolorization toner is used which is set in main memory 120. When MFP 1 is using ordinary toner (NO at S221) at Step S221, the process goes to S223 and the sum is compared with the life value of the expendable when ordinary toner is used which is stored in main memory 120. Next, at Step S224, it is discriminated whether the value obtained at Step S222 or Step S223 is equal to the life set in main memory 120 or more. When the value is discriminated to be equal to the life or more (YES at Step S224), the process goes to Step S226 and an alarm is displayed. Therefore, appropriate life control such as exchange of the expendable or addition of a new one is executed. When the value is discriminated at Step S224 to be less than the life (NO at Step 224), the process goes to Step S227 and the operation of MFP 1 is continued.

Further, in decolorization developing device 14*a* or ordinary developing device 14*b* which is exchanged and used when using decolorization toner or ordinary toner, from a result of counting by developer counter C113 or developer counter D114 for counting the respective image forming histories, whether the developer has done its term of service is detected. When the effect that the developer has done its term of service is detected, similarly to the case of photosensitive drum 11, a warning sentence is given to the user by an alarm. "The developer has done its term of service" means a state that the carrier composing the developer is deteriorated and the charging amount of toner becomes unsuitable. Namely, the toner is not charged up to a predetermined value. From the aforementioned, also for the expendables used for decolorization toner and ordinary toner, appropriate life control is executed. Further, for the other necessary expendables, the life control can be executed by the counter.

On the other hand, depending on use of decolorization toner or ordinary toner in one MFP 1, the image forming mode is switched. In this case, as mentioned above, it is important not only to count the history of each expendable and execute the life control but also to adjust the process conditions relating to each expendable according to the image forming history. Particularly, in photosensitive drum 11 and developing device 14, the image quality is affected greatly.

Firstly, in a case of photosensitive drum 11, with respect to the reduction of the photosensitive film by wear of the photosensitive film on the surface of the photosensitive drum, the degree of consumption is different between a case of use of decolorization toner and a case of use of ordinary toner and the reduction amount is varied with a difference in each image forming history. Therefore, to realize stabilization of the surface potential regardless of the reduction of the photosensitive film of the photosensitive drum, it is necessary, according to the counted value of each image forming history of decolorization toner or ordinary toner by counter A111 or counter B112, to change the process conditions such as the charging current of the main charger, the developing bias potential, and the exposure amount using control program 120.

Figure 5:
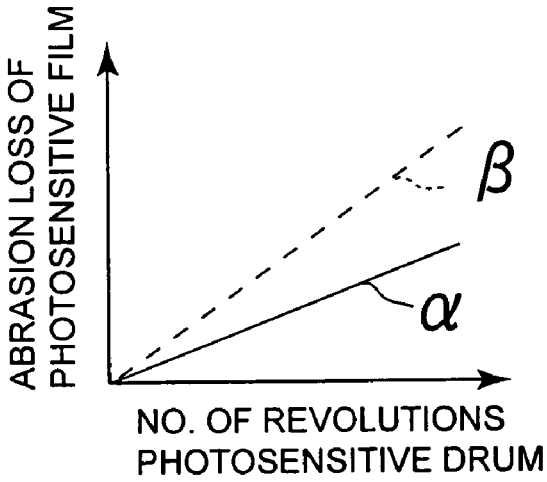
FIG. 5 is a graph showing the abrasion loss of the photosensitive layer by decolorization toner and ordinary toner.

Generally, in the photosensitive drum, as shown in FIG. 5, the abrasion loss of the photosensitive film when decolorization toner is used is indicated by solid line $\alpha$. On the other hand, the abrasion loss of the photosensitive film when ordinary toner is used is about 2 times as indicated by dotted line β. Actually, a photosensitive drum composed of a photosensitive film of an organic semiconductor with a thickness of 25 μm formed on the surface of a drum-shaped aluminum conductor is loaded in an experiment machine and when decolorization toner and ordinary toner are used respectively, the scraped amount of the photosensitive film due to the image forming history, the charging characteristic of the photosensitive film, and the difference in adjustment of the exposure amount are checked, thus the following results are obtained.

Figure 6:
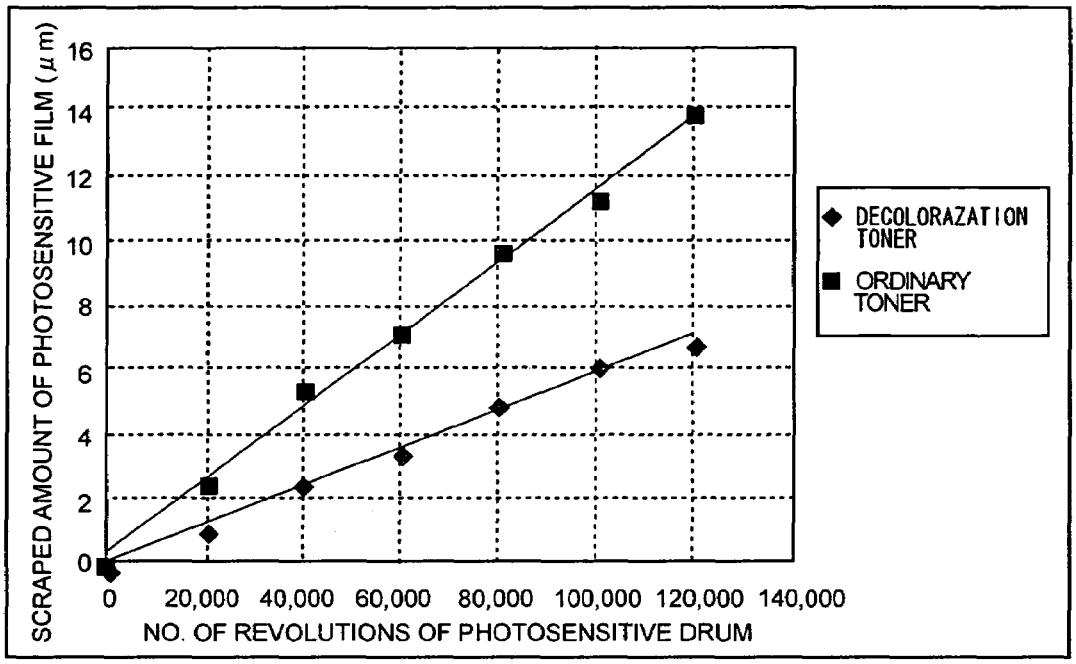
FIG. 6 is a graph showing the scraped amount of the photosensitive layer of decolorization toner and ordinary toner according to the image forming history of the photosensitive drum.

(1) Image forming history and scraped amount of photosensitive film:

The scraped amount of the photosensitive film when ordinary toner is used and decolorization toner is used under the condition of one-sheet intermittence and the results shown in FIG. 6 are obtained. "One-sheet intermittence" means that when the number of copies is set to "1" and one sheet is copied, to set the number of copies to "1" and copy one sheet is repeated. The scraped amount of the photosensitive film when ordinary toner is used is about 7 μm when the number of rotations of the photosensitive drum is 60000 and about 13.5 μm when the number of rotations thereof is 120,000. On the other hand, the scraped amount of the photosensitive film when decolorization toner is used is almost a half of that when ordinary toner is used such as about 3.3 μm when the number of rotations is 60,000 and about 6.5 μm when the number of rotations is 120,000.

Figure 7:
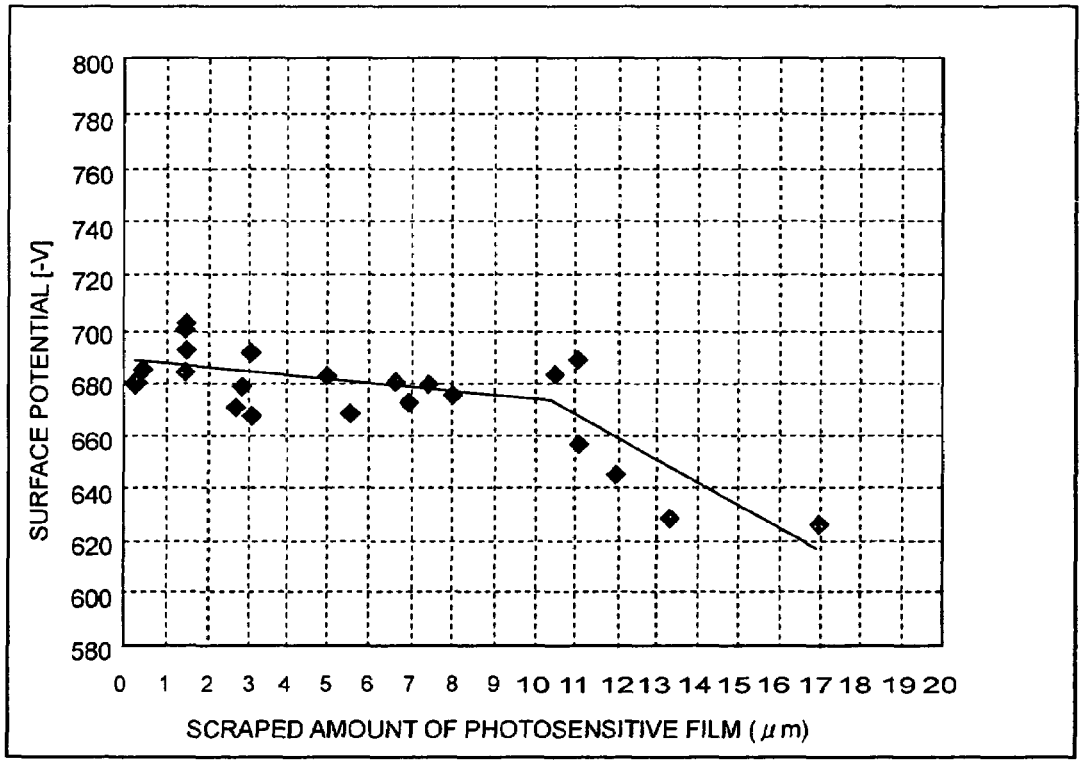
FIG. 7 is a graph showing changes in the surface potential of the photosensitive drum of decolorization toner and ordinary toner due to changing in the scraped amount of the photosensitive layer.

(2) Charging characteristic of photosensitive drum:

Vgb0 which is an initial value of the grid bias potential of the charger is set to 736 V, and how much surface potential V0 of the photosensitive drum is changed by the scraped amount of the photosensitive film is measured, thus as shown in FIG. 7, it is found that as the scraping of the photosensitive film proceeds, the surface potential of the photosensitive drum is reduced. Therefore, to keep the surface potential unchanged regardless of scraping of the photosensitive film, grid bias potential Vgb of the charger is set to Vgb=Vgb0×V0(init)÷V0(life). Here, V0(init) indicates an initial value of the surface potential of the photosensitive drum and V0(life) indicates a surface potential of the photosensitive drum according to the image forming history.

(3) Adjustment of exposure amount:

If the photosensitive film is scraped, the sensitivity becomes dull, so that even if the same amount of exposure is given, the surface potential decreases little. Therefore, to maintain the same image regardless of scraping of the photosensitive film, the exposure amount must be increased. The exposure amount is adjusted as a standard of "half exposure amount" that the surface potential of the photosensitive drum is reduced by half. Incidentally, the half exposure amount in the initial state is 3.5 nJ/mm$^2$ as energy density of the laser diode.

For the energy density in the initial state, the "half exposure amount" to be increased when the scraped amount of the photosensitive film is increased is as shown in FIG. 8.

Under the experimental results of (1) to (3), when decolorization toner is used and when ordinary toner is used, the grid bias potential and half exposure amount must be adjusted respectively. FIG. 9 is a table showing an example of adjusted values of the grid bias potential and half exposure amount at the point of time of 0 sheets, 60,000 sheets, and 120,000 sheets when decolorization toner is used and when ordinary toner is used.

Furthermore, in the image forming apparatus, the adjustment of the process conditions due to the reduction of the photosensitive film of the photosensitive drum is necessary and similarly, for each characteristic of the toner used by the developing device, the adjustment of the developing bias potential which is a process condition of the developing device is necessary. Further, when the developer in the developing device is composed of two components of a toner and a carrier, due to the specific density of the toner, the image density, photographic fog, and scattering of the toner are changed. Therefore, in the developing apparatus, generally, the specific density of toner is adjusted so as to be fixed regardless of the image forming history and change in the environment. The adjustment for keeping the specific density of toner unchanged is executed respectively for decolorization toner and ordinary toner.

As detection of the specific density of toner, for example, a sensor detects that as the specific density of toner is increased, the magnetic permeability of the developer is lowered and a sensor optically reads the toner amount adhered to a standard metallic face. The detected specific density of toner is compared with the set value stored beforehand in the data table of the memory, thus the supply of toner is turned ON or OFF, and the specific density of toner is kept constant. However, the output of the sensor for detecting the specific density of toner is affected not only by the specific density of toner but also, for example, by changing in the toner density of the developer due to changing in the charging amount of toner. Therefore, a correction for denying the effect of the change in the toner density of the developer must be executed. However, the toner density of the developer is affected, for example, even by change in the developer characteristics such as the charging amount of toner during repetition of image forming and moreover is affected by the intrinsic tendency of the toner.

Therefore, the data table prepared for decolorization toner and ordinary toner according to the image forming history and environment change is retained in the memory and the toner supply is controlled by comparison with the data table. The decolorization toner, as compared with the ordinary toner, does not contain pigments such as carbon, so that it is apt to have a high electric resistance. Therefore, by repetitive stirring of the developer during image forming, the decolorization toner has a tendency that the charging amount is increased easily. Therefore, the change in the specific density of toner is different from that of the ordinary toner and when the specific density of toner is measured by the magnetic permeability sensor, the measured results are apt to be lowered. Therefore, it is necessary to correct lowering of the specific density of toner according to the image forming history.

Next, the difference in the change in the specific density of toner due to the image forming histories of decolorization toner and ordinary toner will be described on the basis of the experimental results. In the experimental machine, the decolorization developing device and ordinary developing device are loaded exchangeably and the specific density of toner in the developing devices is controlled as indicated below. The specific density of toner is detected using magnetic permeability sensor 45 shown in FIG. 9. Magnetic permeability sensor 45 applies an AC electric field by making drive winding 42 having inserted core 41 touch developer 40 of the developing devices and detects the AC voltage induced according to the magnetic permeability of developer 40 by detection winding 44. The AC voltage is converted to a DC voltage by DC conversion circuit 46, and the DC voltage is output to logic substrate 48 of CPU 101, and the magnetic permeability of developer 40 is detected.

When converting the AC voltage to a DC voltage by DC conversion circuit 46, the magnetic permeability is subject to fixed amplification by the control voltage from D/A converter 47. The auto toner output voltage outputted from DC conversion circuit 46 to logic substrate 48 of CPU 101 after the amplification process is about 4 V, though as the specific density of toner of developer 40 increases, the output voltage decreases.

For the auto toner output voltage, the amplification factor is adjusted according to the digital data value of a 8-bit signal from logic substrate 48 of CPU 101. For example, when setting up MFP 1 in the initial state, so as to set the auto toner output voltage at the magnetic permeability of initial developer 40 just to 4.0 V, the number of adjustment bits of the digital data from logic substrate 48 of CPU 101 is set. Hereafter, when the output voltage from DC conversion circuit 46 is increased higher than 4.0 V due to repetitive image forming by MFP 1, it is judged that the specific density of toner is lowered and basically, an operation of automatically supplying toner is started. By this automatic toner supply, the specific density of toner is retained constant.

Figures 11, 12:
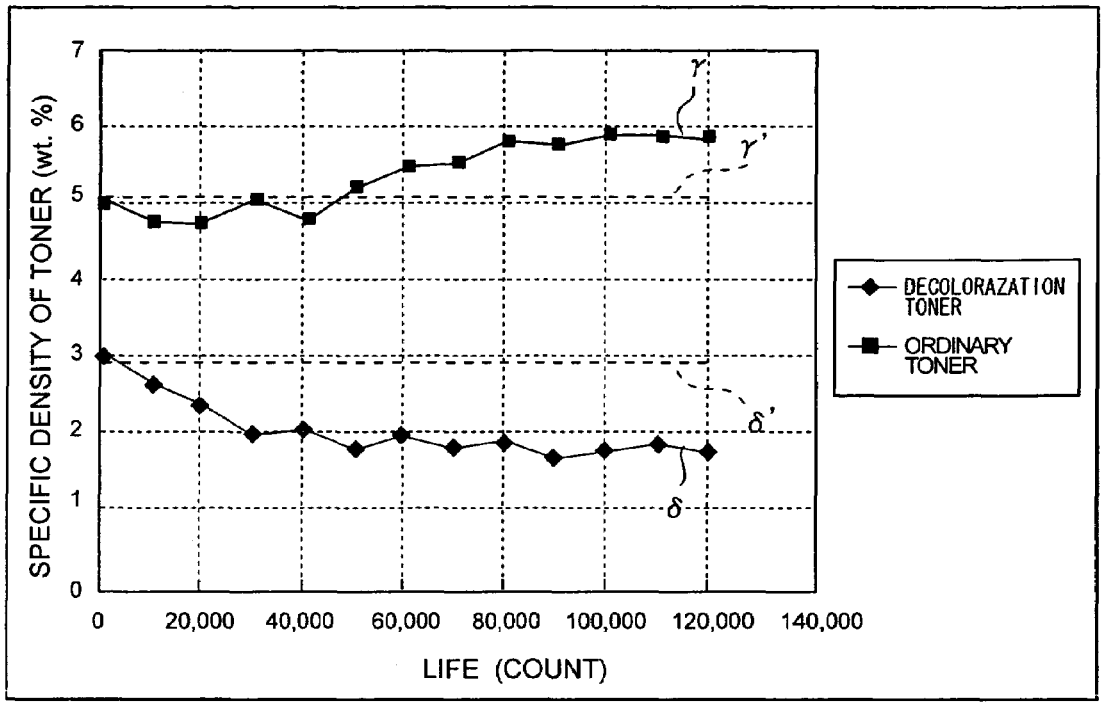
FIG. 11 is a graph showing the transition of the specific density of decolorization toner and ordinary toner.
FIG. 12 is a table showing detection results of the bit value change of the number of adjusted bits and half exposure amount according to the history of image forming of decolorization toner and ordinary toner.
Figure 13:
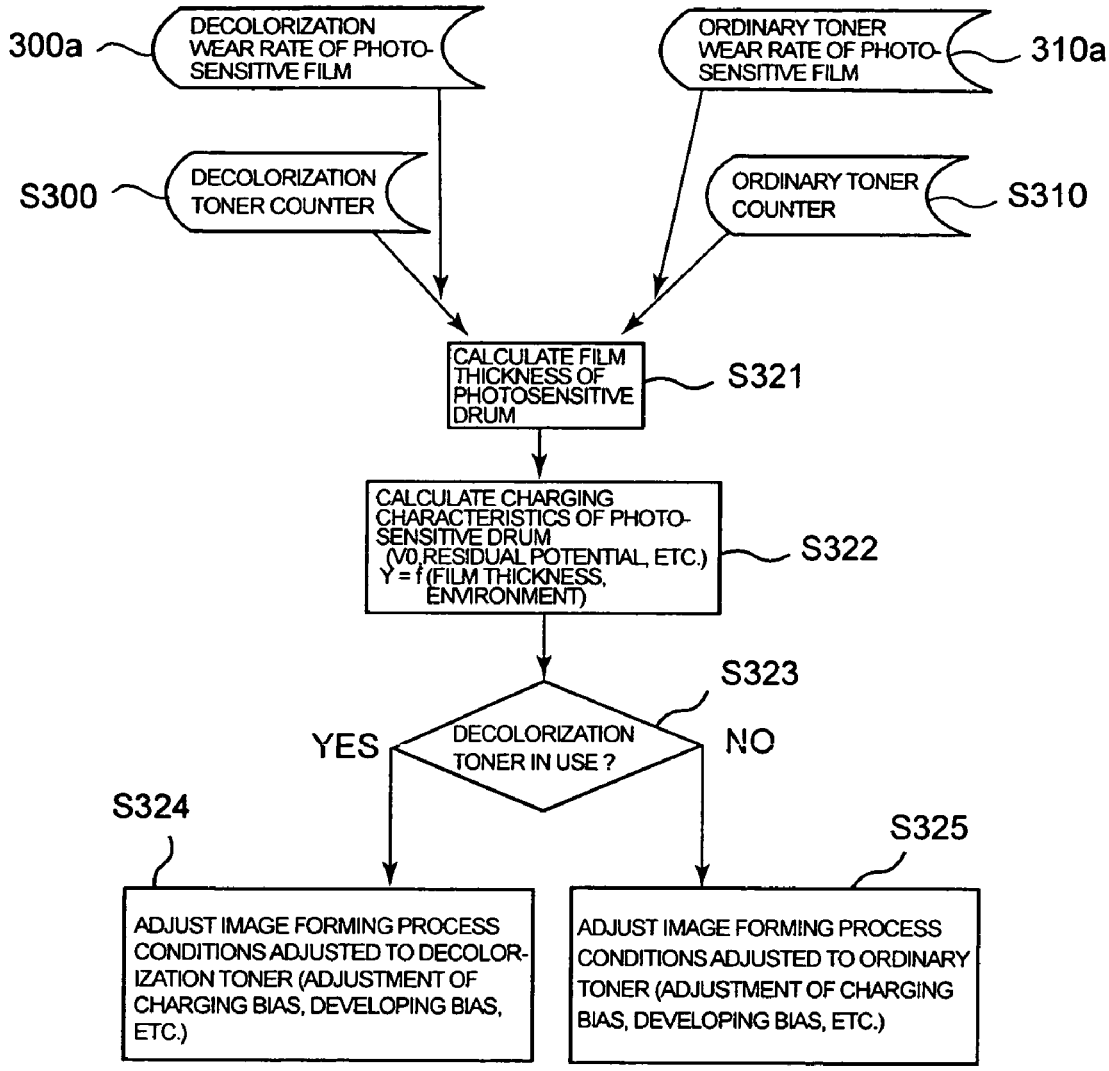
FIG. 13 is a flow chart showing the adjustment control of the process conditions of the image forming apparatus of an embodiment of the present invention.

Next, by keeping the number of bits of the digital data from logic substrate 48 of CPU 101 to D/A converter 47 unchanged, the life test is executed by decolorization toner and ordinary toner. Firstly, the initial specific density of decolorization toner is set to 3% and the initial specific density of ordinary toner is set to 5%. With respect to the change in the specific density of toner, as shown in FIG. 11, in a case of ordinary toner, as shown by solid line γ, the specific density of toner increases. In a case of decolorization toner, as shown by solid line δ, a tendency of decreasing in the specific density of toner is shown. In the magnetic permeability sensor 45, when the developer is the same, the number of adjustment bits of the digital data from logic substrate 48 of CPU 101 and the auto toner output voltage from DC conversion circuit 46 are almost proportional to each other. For example, at one bit, the specific density of toner is changed by about 0.2%.

Therefore, to keep the change in the specific density of toner constant regardless of the image forming history of each toner, on the basis of the data shown in FIG. 11, a variable table of the number of adjustment bits according to the image forming history is prepared for both of decolorization toner and ordinary toner and the auto toner output voltage is adjusted. When the adjustment is performed, for both of decolorization toner and ordinary toner, as indicated by dotted line γ' and dotted line δ' shown in FIG. 11, the stable changes in the specific density of toner can be obtained. On the basis of these results, in a case of use of decolorization toner and a case of use of ordinary toner, the number of adjustment bits according to the image forming history is set. FIG. 12 shows an example of changes in the number of adjustment bits at the point of time of 0 sheets, 60,000 sheets, and 120,000 sheets when decolorization toner is used and when ordinary toner is used.

Furthermore, the developing device requires adjustment of the process conditions for keeping the specific density of toner constant and moreover many characteristics such as the charging amount of the toner and the degree of fluidity of the developer affect the image quality such as the image density and photographic fog. Therefore, these characteristics must be adjusted according to the image forming histories of decolorization toner and ordinary toner and environmental change.

The adjustment of the process conditions such as the charged potential of the photosensitive drum, the developing bias potential, and the exposure amount which is generally performed to keep the image quality constant is performed in the image forming apparatus capable of using both decolorization toner and ordinary toner. For that purpose, the adjustment method of the process conditions is different between use of decolorization toner and use of ordinary toner, so that the adjustment must be performed separately according to the image forming histories of decolorization toner and ordinary toner. Each of the process conditions, after the counters are installed in both the decolorization developing device and ordinary developing device and furthermore in MFP 1 and decolorization toner and ordinary toner are distinguished, is adjusted according to the control program for adjustment which is prepared beforehand according to the respective image forming histories.

Next, the procedure of adjustment and control of the process conditions of the expendables by control system 100 will be explained. After it is confirmed by the life control by control system 100 that the respective expendables are appropriate, for the image forming operation, as shown in the flow chart in FIG. 13, the process conditions according to the reduction of the photosensitive film of photosensitive drum 11 of MFP 1 are adjusted. At Step S300 or Step S310, counters 111 to 114 are counted up. At this time, for decolorization toner and ordinary toner, photosensitive film wear rate 300*a* or 310*a* at time of use of each expendable which is stored in main memory 120 is multiplied by the counted value by counter A111 or counter B112 as a multiplier. The wear rate of the photosensitive film is set from the abrasion loss of the photosensitive film shown in FIG. 5 and is retained in main memory 120.

Next, at Step S321, from the count results at Steps S300 and S310, the film thickness of photosensitive drum 11 is calculated. Furthermore, at Step S322, in consideration of the film thickness of photosensitive drum 11 and environmental change, various image forming process conditions for making the charging characteristic of the photosensitive drum appropriate are calculated (V0, residual potential, etc.). Next, at Step S323, it is judged whether decolorization toner is in use or not. When MFP 1 is using decolorization toner (YES at S323), the process goes to Step S324 and the image forming process conditions adjusted to the decolorization toner calculated at Step S322 are adjusted (the charging bias of main charger 12, the transferring bias of transferring charger 16, the developing bias of decolorization developing device 14*a*, and the fixing temperature are adjusted). Namely, at least one of the charging bias of main charger 12, the transferring bias of transferring charger 16, the developing bias of decolorization developing device 14*a*, and the fixing temperature is adjusted. Further, at step S323, when MFP 1 is using ordinary toner (NO at S323), the process goes to Step S325 and the image forming process conditions adjusted to the ordinary toner calculated at Step S322 are adjusted (the charging bias of main charger 12, the transferring bias of transferring charger 16, the developing bias of ordinary developing device 14*b*, and the fixing temperature are adjusted). Namely, at least one of the charging bias of main charger 12, the transferring bias of transferring charger 16, the developing bias of ordinary developing device 14*b*, and the fixing temperature is adjusted. By doing this, in either case of decolorization toner and ordinary toner, regardless of the image forming history or environmental change, the image quality can be kept constant.

Further, control system 100 not only controls the adjustment of the image forming process conditions but also can control all the process conditions necessary for image forming such as the transferring process conditions, cleaning process conditions, or fixing process conditions whenever necessary.

In this embodiment structured like this, MFP 1, separately in a case of use of decolorization toner and a case of use of ordinary toner, counts up the image forming history by counter A111 or counter B112. Further, MFP 1 counts up the image forming histories of decolorization developing device

14*a* and ordinary developing device 14*b* by counter C113 or counter D114. By counting the image forming histories, MFP 1 executes the life control of the expendables and according to the image forming histories, controls the adjustment of the process conditions suited to a case of use of decolorization toner and a case of use of ordinary toner. Therefore, although MFP 1 is a single apparatus, when forming images by selectively using decolorization toner and ordinary toner, it can use effectively the respective expendables and in either of decolorization toner and ordinary toner, until each expendable has done its term of service, can perform satisfactory image forming suited thereto, thus the image quality is improved.

Further, the present invention is not limited to the embodiment aforementioned and can be changed variously in design and within a range which is not deviated from the object of the present invention, for example, the image forming apparatus may share various kinds of expendables for decolorization toner and various kinds of expendables for ordinary toner in the main body. Or, the apparatus may change the expendables depending on decolorization toner or ordinary toner. Furthermore, the image forming apparatus may be a color image forming apparatus capable of using decolorization toner and ordinary toner. The other constitution of the overall image forming apparatus is not specified particularly and an image forming apparatus used generally is acceptable.

The system configuration for executing the life control of the expendables of the image forming apparatus and the adjustment control of the process conditions is not restricted. For example, with respect to detection of which is in use, decolorization toner or ordinary toner and switching of the toners, when the expendable can be detected according to the toner, the toners may be switched according to the information from the expendable. Or, toner can be set by the change-over switch of the control panel of the main body of the image forming apparatus. Furthermore, toner can be switched and set from an external PC via the controller. Furthermore, in this embodiment, the case that the function for executing the present invention is recorded beforehand in the image forming apparatus is explained. However, the present invention is not limited to it and the same function may be down-loaded in the apparatus from the network. Or, a recording medium wherein the same function is stored may be installed in the apparatus. If a recording medium can store a program like a CD-ROM and can be read by the apparatus, the form thereof is optional. Further, the function obtained by installing or down-loading beforehand like this may realize the function by cooperation with the operating system in the apparatus.

The present invention counts the image forming history by decolorization toner and the image forming history by ordinary toner and executes the life control for the expendables only for decolorization toner or ordinary toner and the expendables shared by both toners. By this life control, effective use of the respective expendables is realized. Further, the image forming histories when decolorization toner is used and ordinary toner is used are counted respectively, and the devices and changes in the toner characteristics are confirmed, so that the process conditions suited to both toners can be adjusted and the image qualities can be improved respectively according to the use objects of both toners.

What is claimed is:

1. An image forming method for switching and using a decolorization toner or an ordinary toner and forming a toner image on a photosensitive drum, comprising:

counting a using history of the decolorization toner;

counting a using history of the ordinary toner;

calculating a film thickness of the photosensitive drum based on both counting the using histories;

calculating various image forming process conditions for making a charging characteristic of the photosensitive drum appropriate in consideration of the film thickness;

detecting which one is in use of the decolorization toner and the ordinary toner;

adjusting the image forming condition to the decolorization toner with the calculated various image forming process conditions when it is detected that the decolorization toner is in use; and adjusting the image forming condition to the ordinary toner with the calculated various image forming process conditions when it is detected that the ordinary toner is in use.

2. The image forming method according to claim 1, further comprising:

adjusting the image forming condition of an expendable used only at time of the image forming by the decolorization toner on the basis of the counted using history of the decolorization toner; and adjusting the image forming condition of an expendable used only at time of the image forming by the ordinary toner on the basis of the counted using history of the ordinary toner.

3. The image forming method according to claim 2, wherein the image forming condition is at least one of a charging bias, an exposure amount, a developing bias, a transferring bias or a fixing temperature.

* * * * *